US011749923B2

(12) United States Patent
Costello et al.

(10) Patent No.: US 11,749,923 B2
(45) Date of Patent: Sep. 5, 2023

(54) COOLING SYSTEM FOR SOCKET CONNECTOR

(71) Applicant: TE Connectivity Services GmbH, Schaffhausen (CH)

(72) Inventors: Brian Patrick Costello, Scotts Valley, CA (US); Alex Michael Sharf, Harrisburg, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 148 days.

(21) Appl. No.: 17/231,040

(22) Filed: Apr. 15, 2021

(65) Prior Publication Data

US 2022/0336982 A1 Oct. 20, 2022

(51) Int. Cl.
*H01R 12/82* (2011.01)
*H01R 13/52* (2006.01)

(52) U.S. Cl.
CPC ..... *H01R 12/82* (2013.01); *H01R 13/5202* (2013.01)

(58) Field of Classification Search
CPC ..... H01R 12/82; H01R 13/5202
See application file for complete search history.

(56) References Cited

U.S. PATENT DOCUMENTS

| | | | | |
|---|---|---|---|---|
| 9,600,039 | B2 | 3/2017 | Taguchi | |
| 10,168,749 | B2 | 1/2019 | Aoki et al. | |
| 2006/0052011 | A1* | 3/2006 | Goodman | H01R 13/2421 439/700 |
| 2008/0009148 | A1* | 1/2008 | Goodman | G01R 1/0483 439/66 |

FOREIGN PATENT DOCUMENTS

| | | | |
|---|---|---|---|
| CN | 203696204 | * | 7/2014 |
| JP | 4508939 | B2 | 7/2010 |
| WO | 2008006045 | * | 10/2008 |

* cited by examiner

*Primary Examiner* — Jean F Duverne

(57) ABSTRACT

An electronic assembly is provided and includes a host circuit board having an upper surface and board contacts on the upper surface. The upper surface has a mounting area. The electronic assembly includes a socket connector mounted to the host circuit board at the mounting area. The socket connector includes a socket housing holding a plurality of socket contacts. Each socket contact has an upper contact portion and a lower contact portion. The lower contact portion is electrically connected to the corresponding board contact of the host circuit board. The socket contact is compressible between the upper contact portion and the lower contact portion. The socket housing includes coolant channels configured to receive coolant. The electronic assembly includes an electronic package coupled to the socket connector. The electronic package has a lower surface and package contacts on the lower surface. The package contacts are electrically connected to the upper contact portions of the socket contacts.

20 Claims, 3 Drawing Sheets

COOLING SYSTEM FOR SOCKET CONNECTOR

BACKGROUND OF THE INVENTION

The subject matter herein relates generally to electrical interconnects.

Electrical interconnects are used to connect two opposing electronic packages. For instance, electrical interconnects may be provided between two circuit boards or a circuit board and an integrated circuit to transmit data and/or power therebetween. Some known electrical interconnects are surface mountable with an array of contacts having separable mating interfaces for connection to the electronic packages rather than by soldering the contacts to the electronic packages. The electrical interconnects use cantilevered beam contacts to provide a separable mating interface at distal ends of the cantilevered beams. Some known electrical interconnects are used to transmit data and power between the electronic packages. The contacts are typically relatively thin for mechanical and signal integrity purposes. However, when transmitting power, the current carrying ability of the contact is limited. For example, the size of the contact may limit the current carrying ability of the contact. As the current increases, the temperature of the contact increases. At extreme elevated temperatures, the contact may be subjected to stress relaxation, which increases contact resistance leading to a further increase in temperature and accelerate failure of the contact. Additionally, at extreme elevated temperatures, the plastic housing that holds the contacts can become soft and no longer maintain dimensional stability. As such, the current transmitted through the electrical interconnect is limited to avoid damaging the contacts and the plastic housing or the number of contacts provided is increased to increase the total current transmitted by the electrical interconnect, which increases the overall size of the electrical interconnect.

A need remains for an interconnect system having improved current transmission capacity for transmitting power between certain electronic packages.

BRIEF DESCRIPTION OF THE INVENTION

In one embodiment, an electronic assembly is provided and includes a host circuit board having an upper surface and board contacts on the upper surface. The upper surface has a mounting area. The electronic assembly includes a socket connector mounted to the host circuit board at the mounting area. The socket connector includes a socket housing holding a plurality of socket contacts. Each socket contact has an upper contact portion and a lower contact portion. The lower contact portion is electrically connected to the corresponding board contact of the host circuit board. The socket contact is compressible between the upper contact portion and the lower contact portion. The socket housing includes coolant channels configured to receive coolant. The electronic assembly includes an electronic package coupled to the socket connector. The electronic package has a lower surface and package contacts on the lower surface. The package contacts are electrically connected to the upper contact portions of the socket contacts.

In another embodiment, an electronic assembly is provided and includes a backerplate having an upper surface and a lower surface opposite the upper surface. The backerplate includes mounting openings for receiving mounting hardware. The backerplate includes backerplate coolant channels for receiving coolant. The electronic assembly includes a host circuit board having an upper surface and a lower surface opposite the upper surface. The lower surface of the host circuit board is mounted to the upper surface of the backerplate. The host circuit board has board contacts on the upper surface. The upper surface has a mounting area. The host circuit board includes board coolant channels extending between the upper surface and the lower surface within the mounting area. The board coolant channels are in fluid communication with the backerplate coolant channels for coolant flow through the board coolant channels. The electronic assembly includes a socket connector mounted to the host circuit board at the mounting area. The socket connector includes a socket housing holding a plurality of socket contacts. Each socket contact has an upper contact portion and a lower contact portion. The lower contact portion is electrically connected to the corresponding board contact of the host circuit board. The socket contact is compressible between the upper contact portion and the lower contact portion. The socket housing includes coolant channels in fluid communication with the board coolant channels for coolant flow through the coolant channels. The electronic assembly includes an electronic package coupled to the socket connector. The electronic package has a lower surface and package contacts on the lower surface. The package contacts are electrically connected to the upper contact portions of the socket contacts.

In a further embodiment, a socket connector is provided and includes socket contacts arranged in an array. Each socket contact has an upper contact portion and a lower contact portion. The upper contact portion has an upper mating interface for interfacing with a corresponding package contact of an electronic package. The lower contact portion has a lower mating interface for interfacing with a corresponding board contact of a host circuit board. The socket contact forming a transmission path between the electronic package and the host circuit board. The socket contact is compressible between the upper contact portion and the lower contact portion. The socket connector includes a socket housing includes a contact holder holding the socket contacts. The contact holder extending between an upper surface and a lower surface. The contact holder includes coolant channels for coolant flow through the contact holder.

DETAILED DESCRIPTION OF THE INVENTION

Figure 1:
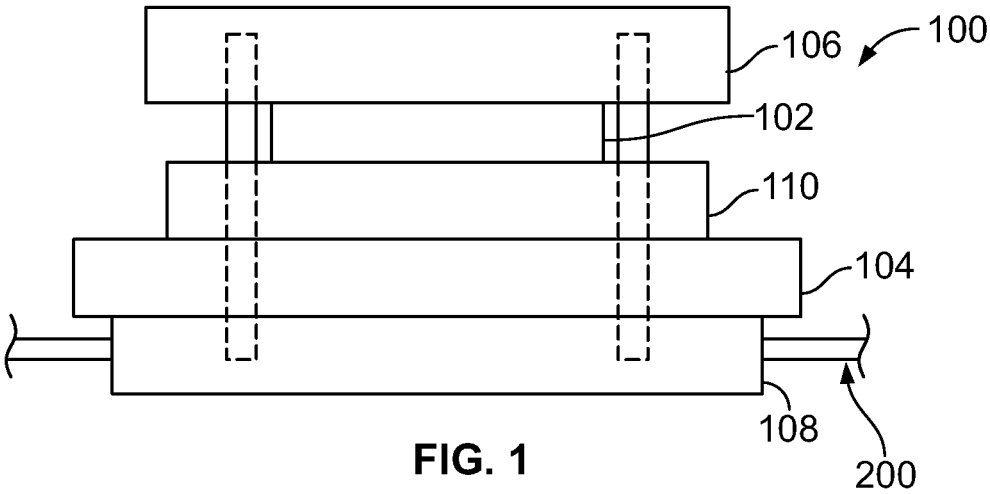
FIG. 1 illustrates an electronic assembly in accordance with an exemplary embodiment having a socket connector formed in accordance with an exemplary embodiment.
Figure 2:
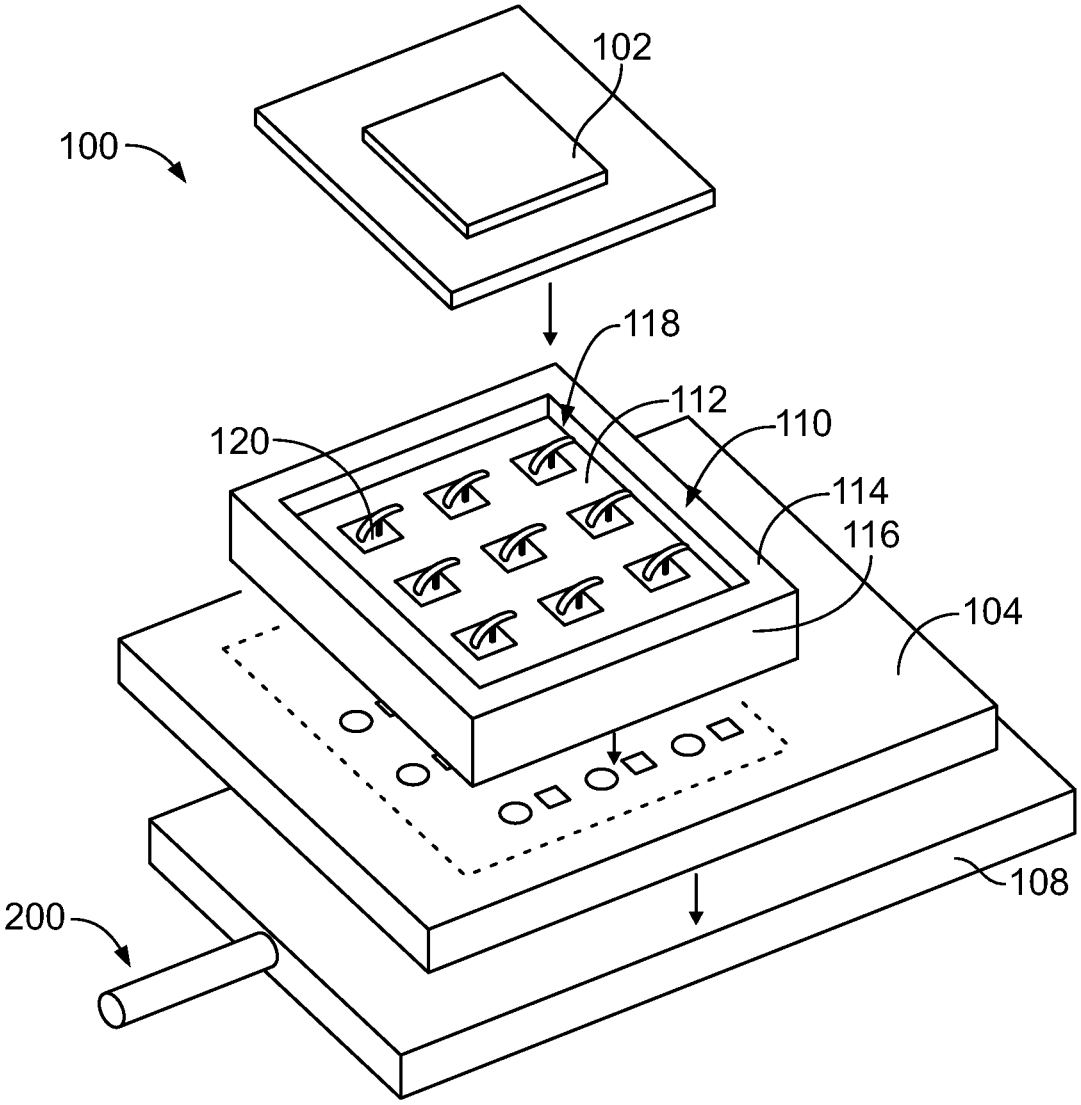
FIG. 2 is an exploded view of the electronic assembly shown in FIG. 1 in accordance with an exemplary embodiment.

FIG. 1 illustrates an electronic assembly 100 in accordance with an exemplary embodiment having a socket connector 110 (shown in FIG. 2) formed in accordance with an exemplary embodiment. FIG. 2 is an exploded view of the electronic assembly 100 shown in FIG. 1 in accordance with an exemplary embodiment.

The socket connectors 110 are used to interconnect first and second electronic packages 102, 104. The electronic packages 102 and 104 may be either circuit boards or electronic devices, such as a chip or module, such as, but not limited to, a central processing unit (CPU), microprocessor, an application specific integrated circuit (ASIC), or the like. As such, the socket connector 110 may be one of a board-to-board, board-to-device, or device-to-device type of interconnect system. Optionally, multiple socket connectors 110 may be provided that receive corresponding electronic packages 102. In an exemplary embodiment, the electronic assembly 100 includes a heat sink 106 at a top of the assembly and a backerplate 108 at a bottom of the assembly. The electronic assembly 100 is assembled using hardware, such as compression hardware, to secure the socket connector 110 between the electronic packages 102, 104. The hardware may be used to secure the heat sink 106 to the electronic package 102. In an exemplary embodiment, the hardware may pass through the heat sink 106 and/or the electronic packages 102, 104 and/or the socket connector 110 and/or the backerplate 108. The socket connector 110 may be compressed between the electronic packages 102, 104 when the hardware is secured to the heat sink and the backerplate 108.

In the illustrated embodiment, the first electronic package 102 is an integrated circuit assembly, such as an ASIC. The first electronic package 102 is coupled to the socket connector 110 to electrically connect the first electronic package 102 to the second electronic package 104. The integrated circuit assembly of the first electronic package 102 includes a substrate, such as a package circuit board, and an electronic component, such as a chip, processor, memory, and the like, mounted to the substrate. The first electronic package 102 may be another type of electronic package in alternative embodiments, such as a pluggable module, a cable connector, a fiber optic module, and the like. In other alternative embodiments, the first electronic package 102 may be a circuit board and the socket connector 110 may be a mezzanine interconnect between the circuit boards. The heat sink 106 may be coupled to the top of the first electronic package 102 to dissipate heat from the first electronic package 102.

In the illustrated embodiment, the second electronic package 104 is a circuit board, such as a host circuit board and may be referred to herein after as a host circuit board 104. The socket connector 110 is mounted to the host circuit board 104 to electrically connect the socket connector 110, and thus the first electronic package 102, to the host circuit board 104. Other types of electronic packages may be used in alternative embodiments. The backerplate 108 is used to support the host circuit board 104. For example, the backerplate 108 is coupled to the bottom of the host circuit board 104 using the hardware.

The socket connector 110 includes a socket housing 112 configured to hold an array of socket contacts 120. The contacts 120 within the contact array are arranged in a predetermined pattern, such as in rows and columns. The socket contacts 120 are used to electrically connect the first electronic package 102 with the host circuit board 104. In an exemplary embodiment, the socket connector 110 includes a socket frame 114 that holds the socket housing 112. Optionally, the socket frame 114 includes frame members 116 forming a socket opening 118 that receives the first electronic package 102. The frame members 116 locate the first electronic package 102 relative to the socket housing 112 and the socket contacts 120. The socket frame 114 is configured to be coupled to the host circuit board 104. The socket frame 114 is used to position the socket housing 112, and thus the socket contacts 120, with respect to the host circuit board 104. The socket frame 114 may operate as an anti-overstress load bearing member that stops or limits compression of the socket contacts 120 when the electronic assembly 100 is assembled. In various embodiments, the socket frame 114 may completely surround the perimeter of the socket housing 112. Optionally, the socket frame 114 may have separate components provided at predetermined portions, such as at corners, of the socket connector 110. The first electronic package 102 is loaded into the socket opening 118. The frame members 116 orient the first electronic package 102 relative to the socket housing 112. When mated with the socket housing 112, the first electronic package 102 is electrically connected to the electronic package 104.

In an exemplary embodiment, the electronic assembly 100 includes a coolant system 200 for cooling the components of the electronic assembly 100. The coolant system 200 may provide convection cooling for the components of the electronic assembly 100. The coolant system 200 is used for internal cooling of the components, such as the socket connector 110. For example, the coolant system 200 is used to cool the socket contacts 120. The coolant system 200 may additionally cool the first electronic package 102 and/or the host circuit board 104. The coolant system 200 receives coolant, such as liquid coolant, to cool the components. In various embodiments, the coolant is a dielectric fluid to avoid short circuiting of the socket contacts 120. The coolant is electrically inert. The coolant has significantly higher thermal conductivity than air. The components may be actively cooled by the coolant, such as by direct contact and/or flow of coolant with the components. In various embodiments, the coolant system 200 may include a pump for forcing the coolant to flow through the electronic assembly 100. In various embodiments, the coolant system 200 may be an immersion coolant system having the components of the electronic assembly immersed in immersion coolant, such as electrically non-conductive fluid.

The first electronic package 102 has a mating interface at a bottom thereof for mating with the socket contacts 120. The first electronic package 102 may include a plurality of the package contact pads (not shown in FIG. 1) that interface with the contacts 120. The coolant system 200 may be used to provide cooling at the mating interface of the first electronic package 102. The host circuit board 104 also has a mating interface at a top thereof for mating with the socket contacts 120. The host circuit board 104 may include a plurality of board contact pads (not shown in FIG. 1) that interface with the socket contacts 120. The coolant system 200 may be used to provide cooling at the mating interface of the host circuit board 104. The mating interfaces may be land grid array (LGA) interfaces. The mating interfaces may have substantially similar pattern as the socket contacts 120 for mating thereto.

Figure 3:
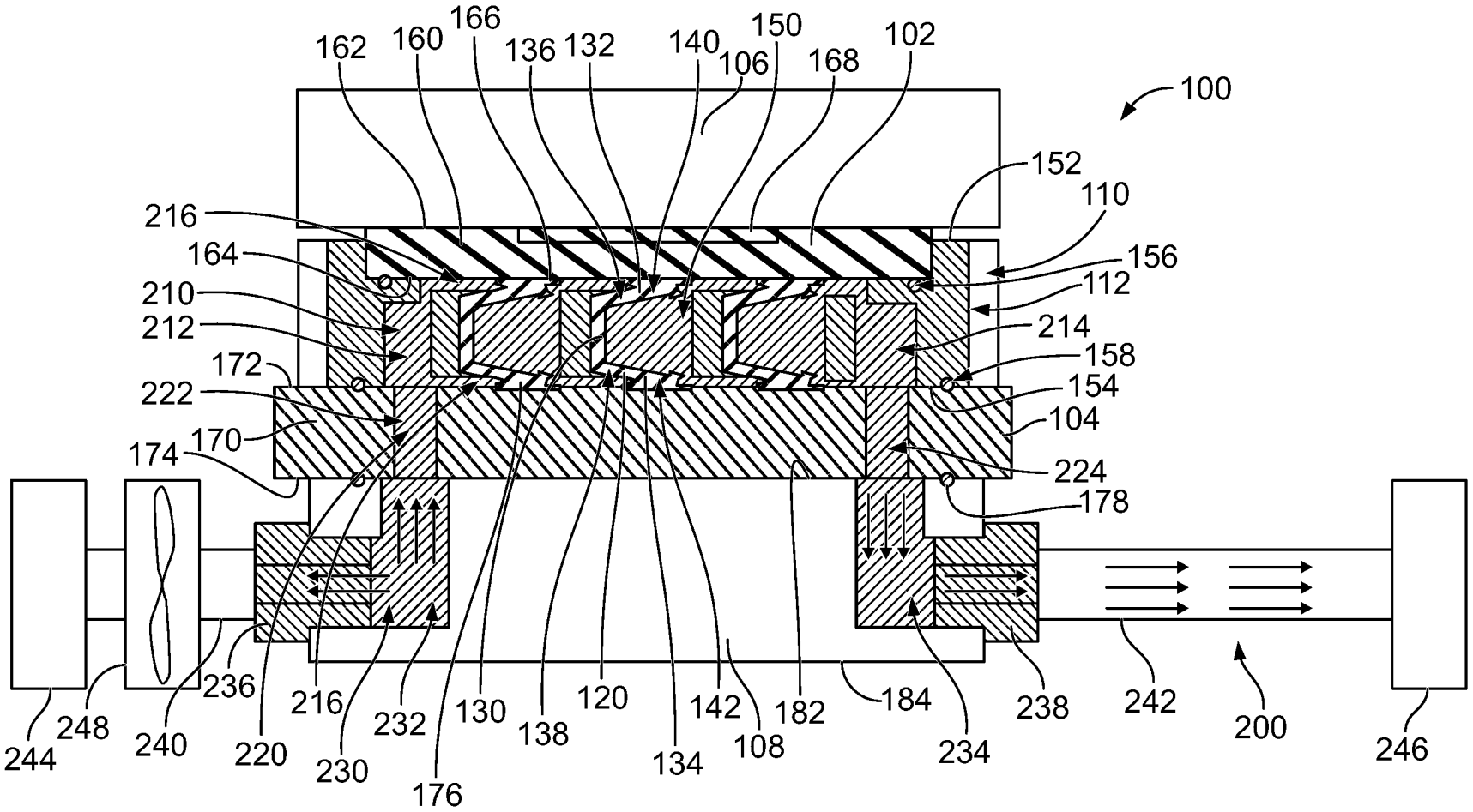
FIG. 3 is a cross sectional view of the electronic assembly in accordance with an exemplary embodiment.

FIG. 3 is a cross sectional view of the electronic assembly 100 in accordance with an exemplary embodiment. The socket connector 110 is provided between the electronic package 102 and the host circuit board 104 to electrically connect the electronic package 102 and the host circuit board 104. The heat sink 106 and the backerplate 108 are coupled to the electronic package 102 and the host circuit board 104, respectively. The heat sink 106 compresses the electronic package 102 against the socket connector 110 to compress the socket contacts 120. The coolant system 200 is in fluid communication with the socket connector 110 to provide cooling for the socket contacts 120. By reducing the operating temperature of the socket contacts 120 using the coolant, when compared to cooling with air, the socket contacts 120 may be used to transmit more current. The current carrying capacity of the socket connector 110 is increased by the use of the coolant system 200.

The socket contacts 120 include a contact body 130 extending between an upper contact portion 132 and a lower contact portion 134. In the illustrated embodiment, the upper contact portion 132 includes a spring beam 136 and the lower contact portion 134 includes a spring beam 138. The upper contact portion 132 includes an upper mating interface 140 proximate to the distal end of the spring beam 136. The lower contact portion 134 includes a lower mating interface 142 proximate to the distal end of the spring beam 138. The spring beams 136, 138 are deflectable and are configured to be spring biased against mating contacts of the electronic package 102 and the host circuit board 104, respectively. For example, the spring beams 136, 138 are compressed inward when the electronic assembly 100 is assembled causing the spring beams 136, 138 to spring bias outward for physical and electrical contact with the mating contacts of the electronic package 102 and the host circuit board 104. The socket contacts 120 are electrically conductive between the upper and lower contact portions 132, 134 to electrically connect the electronic package 102 and the host circuit board 104. In the illustrated embodiment, the socket contact 120 is a dual beam contact having the spring beams 136, 138 at opposite ends of the socket contact 120. The socket contact 120 has separable mating interfaces at the opposite ends. Other types of socket contacts 120 may be provided in alternative embodiments, such as having a solder pad at the lower contact portion 134 forming a ball grid array for termination to the host circuit board 104.

The socket connector 110 includes the socket housing 112 holding the socket contacts 120. In an exemplary embodiment, the socket housing 112 includes a dielectric body having contact channels 150, which hold corresponding socket contacts 120. The dielectric body may be a plastic body, such as a molded body that is injection molded with the contact channels 150 formed therethrough. The socket housing 112 extends between an upper surface 152 and a lower surface 154. The upper surface 152 faces the electronic package 102. The lower surface 154 faces the host circuit board 104.

In an exemplary embodiment, the socket housing 112 includes an upper seal 156 at the upper surface 152 that provides a sealed interface between the socket housing 112 and the electronic package 102. The socket housing 112 includes a lower seal 158 at the lower surface 154 that provides a sealed interface between the socket housing 112 and the host circuit board 104. The upper and lower seals 156, 158 provide sealing for the coolant of the coolant system 200, such as to prevent leakage of the coolant from the interior of the electronic assembly 100. The upper and lower seals 156, 158 may be gaskets. In various embodiments, the upper and lower seals 156, 158 may be manufactured from a compressible material such as polyurethane, rubber, PTFE, and the like. The upper and lower seals 156, 158 may be continuous, extending entirely circumferentially around the sealed area. For example, the upper and lower seals 156, 158 may be located proximate to a perimeter of the socket housing 112 to surround all of the socket contacts 120. In alternative embodiments, the upper and lower seals 156, 158 may surround a sealed area, encompassing a plurality of the socket contacts 120 (such as an area of the socket connector 110 including the power socket contacts), while not surrounding an unsealed area, encompassing a plurality of the socket contacts 120 (such as an area of the socket connector 110 including signal socket contacts). For example, a central area of the socket connector 110 may be sealed, while the outer perimeter of the socket connector may be unsealed.

In an exemplary embodiment, the socket housing 112 includes coolant channels 210 in the socket housing 112. The coolant channels 210 receive the coolant. The coolant channels 210 may extend through the dielectric body of the socket housing 112 between the upper surface 152 and the lower surface 154. The coolant channels 210 provide cooling for the socket contacts 120. For example, the coolant channels 210 may be open to the socket contacts 120, such as to the contact body 130 and/or the upper contact portions 132 and/or the lower contact portions 134. The coolant channels 210 may be open to the contact channels 150. The coolant channels 210 may extend along the upper surface 152 (for example, by creating a channel in the upper surface 152) to allow flow of the coolant along the electronic package 102 to provide cooling for the electronic package 102 and the upper contact portions 132 of the socket contacts 120. The coolant channels 210 may extend along the lower surface 154 (for example, by creating a channel in the lower surface 154) to allow flow of the coolant along the host circuit board 104 to provide cooling for the host circuit board 104 and the lower contact portions 134 of the socket contacts 120.

In an exemplary embodiment, the coolant channels 210 include an inlet coolant channel 212 and an outlet coolant channel 214. The coolant flows into the socket housing 112 through the inlet coolant channel 212. The coolant flows out of the socket housing 112 through the outlet coolant channel 214. The inlet and outlet coolant channels 212, 214 may extend vertically through the socket housing 112. The inlet and outlet coolant channels 212, 214 may additionally extend horizontally through the socket housing 112 (for example, from front to rear). In an exemplary embodiment, the coolant channels 210 include one or more cross channels 216 extending transversely across (for example, side-to-side) the socket housing 112. The cross channel(s) 214 connect the inlet coolant channel 212 and the outlet coolant channel 214. The cross channels 214 may be provided at the upper surface 152 (for example, the socket housing 112 having an open top that is covered by the electronic package 102) and/or the lower surface 154 (for example, the socket housing 112 having an open bottom that is closed off by the host circuit board 104) and/or through a central portion of the socket housing 112 remote from the upper surface 152 and remote from the lower surface 154 (for example, closed top and closed bottom with internal channels). Optionally, the cross channel(s) 214 may include one or more large open spaces at the upper surface 152 and/or the lower surface 154. For example, the large spaces may be open between outer walls surrounding the exterior of the socket housing 112. In an exemplary embodiment, the inlet coolant channel 212 is an inlet manifold channel used to supply and distribute coolant flow to multiple cross channels 214 and the outlet coolant channel 214 is an outlet manifold channel used to gather and return coolant flow from multiple cross channels 214. Optionally, various coolant channels 210 may be separated from each other by separating walls formed by the material of the socket housing 112.

In an exemplary embodiment, the electronic package 102 includes a substrate 160 having an upper surface 162 and a lower surface 164. The electronic package 102 includes package contacts 166 at the lower surface 164. The socket contacts 120 are electrically coupled to corresponding package contacts 166. The lower surface 164 is coupled to the upper seal 156. In an exemplary embodiment, the heat sink 106 is used to press the electronic package 102 downward into the socket connector 110. The downward pressure compresses the socket contacts 120. The downward pressure compresses the upper seal 156. In an exemplary embodiment, the electronic package 102 includes an electronic component 168, such as a chip, a processor, a memory, and the like. The heat sink 106 is thermally coupled to the electronic component to dissipate heat from the electronic component 168. In an exemplary embodiment, the coolant of the coolant system 200 is used to dissipate heat from the electronic package 102. For example, the coolant may flow along the lower surface 164 to dissipate heat from the substrate 160, which in turn dissipates heat from the electronic component 168.

In an exemplary embodiment, the host circuit board 104 includes a substrate 170 having an upper surface 172 and a lower surface 174. The upper surface 172 faces the socket connector 110. The lower surface 174 faces the backerplate 108. In an exemplary embodiment, the host circuit board 104 includes board contacts 176 at the upper surface 172. The socket contacts 120 are electrically coupled to the corresponding board contacts 176. The upper surface 172 is coupled to the lower seal 158. In an exemplary embodiment, the heat sink 106 presses the electronic package 102 and the socket connector 110 downward into the host circuit board 104. The downward pressure compresses the socket contacts 120 against the board contacts 176. The downward pressure compresses the lower seal 158. In an exemplary embodiment, an interface seal 178 is provided at the interface between the host circuit board 104 and the backerplate 108. The interface seal 178 is sealed between the lower surface 174 and the backerplate 108. The downward pressure compresses the interface seal 178.

In an exemplary embodiment, the host circuit board 104 includes board coolant channels 220 in the host circuit board 104. The board coolant channels 220 receive the coolant. The board coolant channels 220 extend through the substrate 170 between the upper surface 172 and the lower surface 174. The board coolant channels 220 allow flow of the coolant into the interior of the socket housing 112. In an exemplary embodiment, the board coolant channels 220 include an inlet coolant channel 222 in flow communication with the coolant channel 212 and an outlet coolant channel 224 in flow communication with the coolant channel 214. The coolant flows into the socket housing 112 through the inlet coolant channel 222. The coolant flows out of the socket housing 112 through the outlet coolant channel 224. The inlet and outlet coolant channels 222, 224 may extend vertically through the host circuit board 104. The host circuit board 104 may include other coolant channels in alternative embodiments. In alternative embodiments, rather than having the board coolant channels 220, the backerplate 108 may pass through an opening in the host circuit board 104 to directly interface to the socket connector 110 to allow coolant flow between the backerplate 108 and the socket connector 110.

In an exemplary embodiment, the backerplate 108 includes backerplate coolant channels 230 in the backerplate 108. The backerplate coolant channels 230 receive the coolant. The backerplate coolant channels 230 extend through the backerplate 108 between an upper surface 182 and a lower surface 184 of the backerplate 108. The backerplate coolant channels 230 allow flow of the coolant into the interior of the socket housing 112 through the host circuit board 104. In an exemplary embodiment, the backerplate coolant channels 230 include an inlet coolant channel 232 in flow communication with the coolant channel 212 and an outlet coolant channel 234 in flow communication with the coolant channel 214. The coolant flows into the host circuit board 104 and the socket housing 112 through the inlet coolant channel 232. The coolant flows out of the socket housing 112 and the host circuit board 104 through the outlet coolant channel 234. The inlet and outlet coolant channels 232, 234 may extend vertically through the backerplate 108. Other coolant channels may be provided in alternative embodiments, such as a connecting coolant channel between the inlet and outlet coolant channels 232, 234. The connecting coolant channel may include a vapor chamber (not shown) to enhance heat dissipation of the coolant system 200 for cooling the components of the electronic assembly 100.

In an exemplary embodiment, valves 236, 238 are provided at the inlet and outlet coolant channels 232, 234 to control coolant flow through the coolant system 200. The valves 236, 238 may be opened to allow coolant flow or closed to restrict coolant flow. The valves 236, 238 are sealed to the backerplate 108. In the illustrated embodiment, the valves 236, 238 are provided at opposite sides of the backerplate 108. Other locations are possible in alternative embodiments. The backerplate 108 may function as a heat sink or cold plate to dissipate heat into the surrounding environment. The backerplate 108 may have heat dissipating fins. In the illustrated embodiment, the coolant system 200 includes an inlet line 240 coupled to the inlet valve 236 and an outlet line 242 coupled to the outlet valve 238. The inlet line 240 is coupled to a coolant supply 244. The outlet line 242 is coupled to a coolant return 246. The coolant supply 244 and the coolant return 246 may be a common reservoir in various embodiments. For example, the coolant system 200 may be a closed loop system. In an exemplary embodiment, a pump 248 is provided that forces the coolant through the coolant system 200. The pump 248 may be provided at the supply side.

Figure 4:
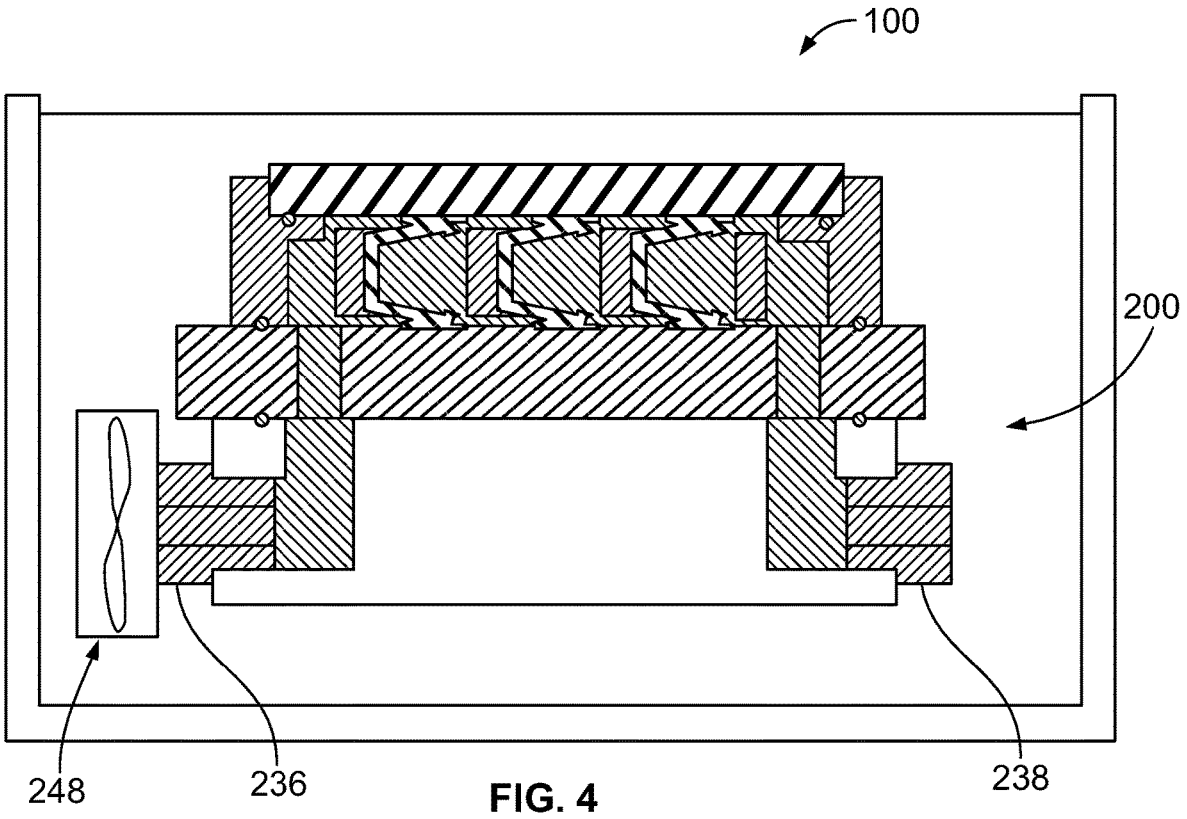
FIG. 4 is a cross sectional view of the electronic assembly in accordance with an exemplary embodiment.

FIG. 4 is a cross sectional view of the electronic assembly 100 in accordance with an exemplary embodiment. FIG. 4 shows the coolant system as an immersion coolant system. The electronic assembly 100 is immersed in fluid, such as in an immersion bath. In the illustrated embodiment, the coolant system 200 does not utilize the inlet and outlet lines 240, 242 (shown in FIG. 3). Rather, the inlet valve 236 receives the fluid from the immersion bath and the outlet valve 238 discharges the fluid directly into the immersion bath. The pump 248 is provided at the inlet valve 236 to force the coolant from the immersion bath through the coolant system 200.

Figure 5:
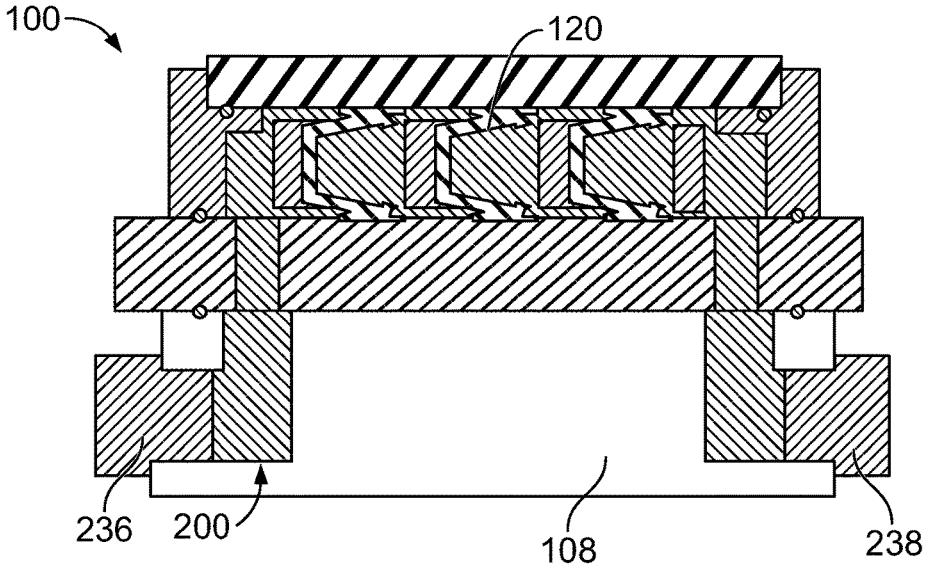
FIG. 5 is a cross sectional view of the electronic assembly in accordance with an exemplary embodiment.

FIG. 5 is a cross sectional view of the electronic assembly 100 in accordance with an exemplary embodiment. FIG. 5 shows the coolant system as a closed coolant system. The inlet and outlet valves 236, 238 are closed and do not allow fluid flow from a supply or discharge to a reserve. The coolant system 200 is filled with fluid and then closed. The coolant surrounds the socket contacts 120 and other components of the electronic assembly 100 to enhance heat dissipation compared to being surrounded by air. The backerplate 108 may be used to dissipate the heat from the system to enhance cooling. The coolant may be internally circulated within the system.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electronic assembly comprising:

a host circuit board having an upper surface and board contacts on the upper surface, the upper surface having a mounting area;

a socket connector mounted to the host circuit board at the mounting area, the socket connector including a socket housing holding a plurality of socket contacts, each socket contact having an upper contact portion and a lower contact portion, the lower contact portion being electrically connected to the corresponding board contact of the host circuit board, the socket contact being compressible between the upper contact portion and the lower contact portion, the socket housing including coolant channels configured to receive liquid coolant, the coolant channels being open through the socket housing to allow liquid coolant flow through the socket housing; and an electronic package coupled to the socket connector, the electronic package having a lower surface and package contacts on the lower surface, the package contacts being electrically connected to the upper contact portions of the socket contacts.

2. The electronic assembly of claim 1, wherein the coolant channels are open to the socket contacts for direct cooling of the socket contacts by the coolant.

3. The electronic assembly of claim 1, wherein the coolant channels are open to the upper contact portions and the lower contact portions.

4. The electronic assembly of claim 1, wherein the coolant channels include an inlet coolant channel and an outlet coolant channel, the coolant flows through the socket housing from the inlet coolant channel to the outlet coolant channel.

5. The electronic assembly of claim 1, further comprising a package seal between the electronic package and the socket connector and a board seal between the host circuit board and the socket connector.

6. The electronic assembly of claim 1, wherein the coolant is pressurized to flow through the coolant channels.

7. The electronic assembly of claim 1, wherein the coolant channels are open to the lower surface of the electronic package to cool the electronic package.

8. The electronic assembly of claim 1, wherein the coolant channels are open to the upper surface of the host circuit board to cool the host circuit board.

9. The electronic assembly of claim 1, wherein the host circuit board includes board coolant channels, the board coolant channels being in fluid communication with the coolant channels of the socket housing to allow flow of coolant between the host circuit board and the socket connector.

10. The electronic assembly of claim 1, further comprising a backerplate having an upper surface and a lower surface opposite the upper surface, the host circuit board being mounted to the upper surface of the backerplate, wherein the backerplate includes backerplate coolant channels, the backerplate coolant channels being in fluid communication with the coolant channels of the socket housing.

11. The electronic assembly of claim 10, wherein the backerplate includes a coolant inlet and a coolant outlet in fluid communication with the backerplate coolant channels, the coolant flowing through the coolant inlet to the backerplate coolant channels and the coolant channels of the socket housing.

12. The electronic assembly of claim 1, wherein the socket housing includes contact channels receiving corresponding signal contacts, the coolant channels including contact coolant channels open to the contact channels to cool the socket contacts in the contact channels.

13. The electronic assembly of claim 1, wherein the contact channels include an inlet manifold channel, an outlet manifold channel, and cross channels between the inlet manifold channel and the outlet manifold channel, the coolant in the cross channels flowing across the socket contacts as the coolant flows from the inlet manifold channel to the outlet manifold channel.

14. An electronic assembly comprising:

a backerplate having an upper surface and a lower surface opposite the upper surface, the backerplate including mounting hardware, the backerplate including backerplate coolant channels for receiving liquid coolant, the backerplate coolant channels being open through the backerplate to allow liquid coolant flow through the backerplate;

a host circuit board having an upper surface and a lower surface opposite the upper surface, the lower surface being mounted to the upper surface of the backerplate, the host circuit board having board contacts on the upper surface, the upper surface having a mounting area;

a socket connector mounted to the host circuit board at the mounting area, the socket connector including a socket housing holding a plurality of socket contacts, each socket contact having an upper contact portion and a lower contact portion, the lower contact portion being electrically connected to the corresponding board contact of the host circuit board, the socket contact being compressible between the upper contact portion and the lower contact portion, the socket housing including coolant channels in fluid communication with the backerplate coolant channels for liquid coolant flow through the coolant channels; and an electronic package coupled to the socket connector, the electronic package having a lower surface and package contacts on the lower surface, the package contacts being electrically connected to the upper contact portions of the socket contacts.

15. The electronic assembly of claim 14, wherein the coolant channels are open to the socket contacts for direct cooling of the socket contacts by the coolant.

16. The electronic assembly of claim 14, further comprising a package seal between the electronic package in the socket connector and a board seal between the host circuit board and the socket connector.

17. The electronic assembly of claim 14, wherein the coolant is pressurized to flow through the coolant channels.

18. The electronic assembly of claim 14, wherein the contact channels include an inlet manifold channel, an outlet manifold channel, and cross channels between the inlet manifold channel in the outlet manifold channel, the coolant in the cross channels flowing across the socket contacts as the coolant flows from the inlet manifold channel to the outlet manifold channel.

19. The electronic assembly of claim 14, wherein the host circuit board includes board coolant channels extending between the upper surface and the lower surface within the mounting area, the board coolant channels being in fluid communication with the backerplate coolant channels and the coolant channels of the socket housing for coolant flow.

20. A socket connector comprising:

socket contacts arranged in an array, each socket contact having an upper contact portion and a lower contact portion, the upper contact portion having an upper mating interface for interfacing with a corresponding package contact of an electronic package, the lower contact portion having a lower mating interface for interfacing with a corresponding board contact of a host circuit board, the socket contact forming a transmission path between the electronic package and the host circuit board, the socket contact being compressible between the upper contact portion and the lower contact portion; and a socket housing including a contact holder holding the socket contacts, the contact holder extending between an upper surface and a lower surface, the contact holder including coolant channels configured to receive liquid coolant, the coolant channels being open to allow liquid coolant flow through the contact holder for cooling the socket contacts.

* * * * *